United States Patent [19]

Roth

[11] 4,358,207

[45] Nov. 9, 1982

[54] BLENDING SYSTEM FOR DRY SOLIDS

[76] Inventor: Clarence E. Roth, 1048 Agusta, Houston, Tex. 77057

[21] Appl. No.: 194,125

[22] Filed: Oct. 6, 1980

[51] Int. Cl.[3] ..... B01F 15/00

[52] U.S. Cl. ..... 366/336; 366/341

[58] Field of Search ..... 222/145, 564; 366/9, 366/336, 338, 341, 340

[56] References Cited

U.S. PATENT DOCUMENTS

| | | | |
|---|---|---|---|
| 633,313 | 9/1899 | Hains et al. . | |
| 1,029,126 | 6/1912 | Hoover . | |
| 1,047,680 | 12/1912 | Mills et al. . | |
| 1,072,143 | 9/1913 | Mills et al. . | |
| 1,224,656 | 5/1917 | McCandliss . | |
| 1,415,830 | 5/1922 | Fredel et al. . | |
| 3,153,578 | 10/1964 | Taylor . | |
| 3,275,303 | 9/1966 | Goins . | |
| 3,532,326 | 10/1970 | Schilling et al. . | |
| 3,675,901 | 7/1972 | Rion . | |
| 4,085,462 | 4/1978 | Booy . | |
| 4,191,480 | 3/1980 | Hiorth | 366/336 |

*Primary Examiner*—Stanley H. Tollberg

*Attorney, Agent, or Firm*—Vaden, Eickenroht, Thompson, Bednar & Jamison

[57] ABSTRACT

A blending system for dispersing continuously in a fixed proportion of a dispersed first solids flow into a second bulk solids flow thereby forming a homogeneous solids flow. The system includes an upright vessel having an outlet for the homogeneous solids at its lower extremity. One or more blending stages are disposed within the vessel above the outlet. The blending stage has an inverted Vee element with inclined side surfaces mounted centrally within the vessel and with its apex pointed upwardly. A first inlet for the first solids resides vertically above the apex of the element. A second inlet for the second solids has a discharge opening about the first inlet and displaced laterally from the apex of the element. The dispersed first solids are supplied at a certain flow rate through the first inlet to flow about the apex of the element and downwardly along its side surfaces. The second solids are supplied at a certain flow rate through the second inlet to flow downwardly along the side surfaces of the element whereat the dispersed first solids are uniformly distributed into the second solids to produce a homogeneous solids flow removed through the outlet from the vessel.

3 Claims, 5 Drawing Figures

BLENDING SYSTEM FOR DRY SOLIDS

In one particular application, the present blending system is adapted to distribute a flow of a particulate mold releasing agent or colorant in an amount of about 0.1% by weight into a flow of plastic pellets wherein the total flow of the homogeneous solids is about 80,000 pounds per hour. The blending system can produce railroad car amounts of plstic pellet mixtures in about three hours of operation.

BACKGROUND OF THE INVENTION

1. Field of the Invention

This invention relates to devices used to combine or mix dry solid constituents into a homogeneous mixture, and more particularly, it relates to a blender for continuously and uniformly distributing a flow of dispersed solids into a flow of another solids to produce a flow of homogeneous solids.

2. Description of Prior Art

Various types of blenders or mixers have been proposed to effect the mixing of solids within solids. For example, many of these devices are operable only on batches of materials. In this case, different solids are placed within a container and therein agitated by paddles, tumbling, or the like, until a one solid is dispersed within the other. These systems are unsatisfactory in that they are a batch operation and useful only with solids having similar densities and other properties which does not detract from the batch type mixing or blending effort. It would be preferable to employ devices for effective distribution continuously of one solid within another solid. However, present mixing systems are not ameniable to producing the distribution uniformly of a first solids amount into second solids in a one pass, continuous flow, low mixing energy mode of operation.

There is a special need in present day, high volume plastic molding operations to supply a homogeneous mixture of plastic pellets containing very small amounts of particulate colorant, mold release agents, slip mortar batch and like additives, which additives usually are not present in amounts more than a 0.1% by weight. It is common practice in the plastics industry for the supplier of custom blended plastic materials to provide railroad car lots of plastic blends to the molder or fabricator of the plastic products. The custom plastic supplier usually secures a large amount of the bulk plastic solids in the form of small pellets in railroad car lots of approximately 180,000 pounds. This bulk plastic solids is presently removed from its shipping containers. Then, the small amounts of colorant, release agent (and other materials) are mixed into the plastic pellets in lots of about 10,000 pounds to produced the desired plastic blends. However, this blending operation has been found to basically involve either high sheer-types of recirculating flows or a multiplicity of batch type operations within mixing vessels. None of these mixing or blending systems is satisfactory because of being time consuming, subjecting the plastic pellets to a high sheer/mechanical abrasion environment which causes melting, dusts or other damage to the plastic pellets.

It would be greatly advantageous to have a system where a flow of the first solids (e.g., additive) is directly and continuously mixed into a flow of the second solids (e.g., plastic pellets) in a single pass between one bulk container and the resultant homogeneous blend of solids is loaded into a suitable hopper, such as a railroad car for shipment directly to the ultimate user. Stated in another manner, the preferred blending system is capable of producing continuously a homogeneous solids flow at a great volume in a single blending stage by the uniform dispersion of a fixed proportion of the dispersed first solids, such as colorant, mold release agent, slip master batch and the like, within a second solids without subjecting the constituents to high sheer or abrasive conditions.

SUMMARY OF THE INVENTION

In accordance with this invention, there is provided a blending system for dispersing continuously in a fixed proportion of a first solids flow into a second solids flow thereby forming a homogeneous solids flow. The system comprises an upright vessel at its lower extremity having an outlet for the homogeneous solids flow. At least one blending stage is disposed within the vessel and located above the outlet. At least one blending stage is provided by an inverted Vee element with inclined side surfaces mounted centrally within the vessel. The apex of this Vee element is pointed upwardly in the vessel. A first inlet for the first solids is mounted in the vessel and positioned vertically above the apex of the element. A second inlet for the second solids is mounted in the vessel with a discharge opening located about the first inlet. This discharge opening is displaced laterally from the apex of the element. The first solids are supplied at a certain flow rate by a first means through the first inlet to flow about the apex of the element and downwardly along its side surfaces. The second solids are supplied at a certain flow rate by a second means through the second inlet to flow downwardly along the side surfaces of the element. As a result of these solids flow along the surfaces of the element, the second solids are uniformly distributed into the second solids to produce a homogeneous solids flow through the outlet of the vessel.

In the preferred embodiment of this invention, the vessel contains a plurality of blending stages superimposed vertically one above the other with the several inlets so arranged that the homogeneous solids flow from one mixing stage becomes the "second" solids flow for the blending stage residing below it. As a result, the "second" solids can be blended to contain several dispersed "first" solids uniformly distributed so as to produce the desired homogeneous solids flow from the outlet of the vessel.

DESCRIPTION OF PREFERRED EMBODIMENTS

Figure 1:
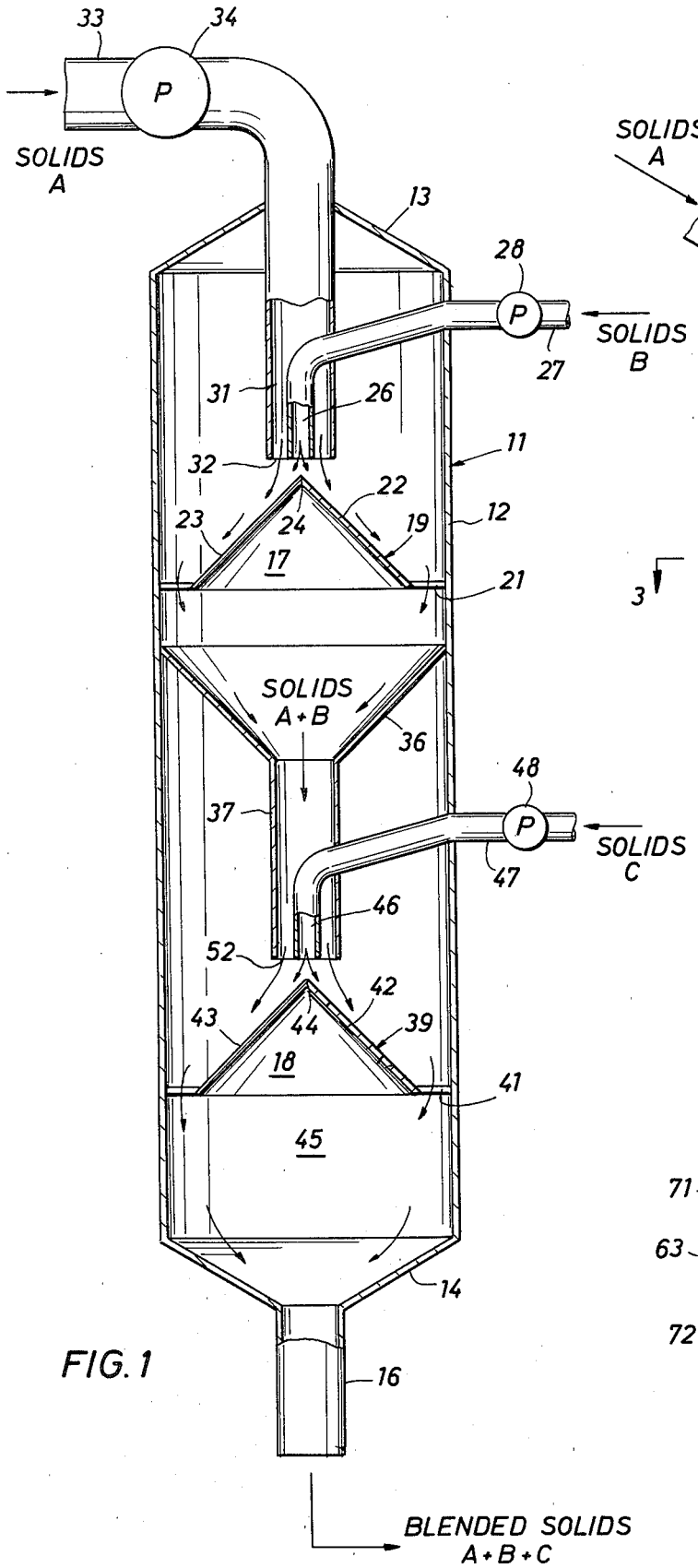
FIG. 1 is an elevation, partially in section, of a blending system arranged in accordance with the present invention and having two blending stages in one vessel.

Referring to FIG. 1, there is shown a blending system 11 constructed in accordance with the present invention, which system provides for dispersing continuously in a fixed proportion of a first solids flow into a second solids flow thereby forming a homogeneous solids flow. More particularly, the system 11 comprises a vessel 12 which preferably is an upright cylindrical metal shell. The vessel 12 is enclosed at its top 13 and has a conical bottom 14 which leads to an outlet 16 where the homogeneous solids flow can be removed. The vessel 12 carries at least one mixing stage 17. Preferably the vessel carries a plurality of mixing stages, such as blending stage 17 superimposed above blending stage 18. Obviously, all mixing stages are vertically positioned above the outlet 16.

The blending stage 17 is provided by an inverted Vee element 19 which is mounted centrally upon radially thin spiders 21 within the vessel 12. The perimeter of the blending stage is spaced from the sidewall of the vessel 12. The element 19 has unbroken inclined side surfaces 22 and 23 which extend downwardly and outwardly from its apex 24 which is pointed upwardly in the vessel 12. Preferably, the side surfaces 22 and 23 are inclined from the vertical in the vessel 12 by substantially equal angles. For best results, these side surfaces should have substantially the same length. The included angle at the apex 24 formed by intersection of the side surfaces 22 and 23 is preferably within the range of between 60 and 120 degrees. The particular angle between these side surfaces in the element 19 can be adjusted relative to the density and flow velocity of the solids that move along them to optimize the uniform distribution of the first solids into the second solids. This included angle should not be too large otherwise the high velocities of the solids impinging upon the element 19 may lead to mechanical injury, melting of plastic pellets, or for other reasons. On the other hand, an apex of very small included angle may not produce the desired uniform distribution of the two solids flow an the element 19. Although either of these solids may be the continuous phase, it is preferred to have the smaller phase or solids introduced as the "first" solids which are dispersed into the "second" solids.

The element 19 is constructed of a suitable rigid material such as metallic sheeting, plates or the like. The side surfaces 22 and 23 do not require any special surface configuration or treatment to function properly. However, it is preferred that these side surfaces be smooth or without projections to injure the moving solids.

The blending stage 17 is provided with a first inlet 26 that is mounted within the vessel 12 and connects to an exterior supply conduit 27. The conduit 27 is connected to a source of the first solids which may be a drum of suitable size to provide a continuous flow relative to the flow of second solids to be passed through the vessel 12. More particularly, the conduit 27 includes a pump 28 for supplying the first solids at a certain flow rate to the inlet 26. Although the pump 28 is shown associated with the conduit 27, it could be a pneumatic conveyor, mechanical impeller, or other transfer mechanism for supplying these solids at the certain flow rate required for the blending operation. The inlet 26 is positioned vertically above the apex 24 of the element 19. The first solids flow downwardly from the inlet 26 about the apex 24, and then, in uniform peripheral flow downwardly along the side surfaces 22 and 23.

The vessel 12 also carries an inlet 31 which is mounted in the vessel and has a discharge opening 32 about the first inlet. This discharge opening 32 is displaced laterally from vertical alignment with the apex 24 of the element 19. The inlet 31 is connected to a supply conduit 33 that is in communication with a source of second solids. This source of solids may be a container, such as a railroad car, which is adapted for pheumatic conveying or mechanical carrying of these solids into the conduit 33. The conduit 33 may include a pump 34 or other solids moving mechanism so that the solids flow continuously at a certain flow rate into the inlet 31. Then, the second solids flow from the inlet 31 downwardly into the element 19 and along its side surfaces 22 and 23.

The intermingled flows of the solids from the inlet 26 and the solids from the inlet 31 along the element 19 produce a uniform dispersion of the first solids within the second solids, i.e., the homogeneous solids flow leaving the element 19. The particular functioning of the element 19 is believed to reside in both solids being subjected to the same peripheral flow about the element 19. It is believed that the first solids, usually being present in smaller amounts, are uniformly distributed about the apex 24 which induces uniform distribution along the surfaces 22 and 23. These solids encounter the second solids which likewise are distributed uniformly in flowing upon the side surfaces 22 and 23 of the element 19. In this manner, the uniform distribution of both phases, in intimate contact, and under uniform peripheral flow conditions, produces the desired uniform dispersion of the first solids within the second solids along the element 19. The homogeneous solids flow leaves the element 19 and gravitates downwardly through region 35 in the vessel 12 and towards the outlet 16. If only the blending stage 17 is employed, the homogeneous solids flow are removed from the vessel 12 through the outlet 16 and passed through a suitable utilizations, such as loading into hoppers or railroad cars for shipment to an ultimate user of the blended solids.

However, in many instances another first solids will be uniformly distributed into the homogeneous solids flow produced by the blending stage 17. For this purpose, the vessel 12 is provided with a collector 36 that is positioned between the two blending stages 17 and 18. Preferably, the collector 36 has a conical wall which leads to a central outlet 37. The outlet 37 carrying the homogeneous solids flow from the first blending stage 17 may be considered to be the second solids flow into the blending stage 18.

The blending stage 18 has an inverted Vee element 39 which is mounted centrally within the vessel 12 by spiders 41. The element 39 has inclined side surfaces 42 and 43 which intersect at an apex 44 that is pointed upwardly within the vessel 12.

The blending stage 18 has an inlet 46 that is connected to a conduit 47. The conduit 47 is connected to a suitable container such as a drum, providing a source of the second solids. A pump 48 within the conduit 47 provides a continuous flow of these solids at a certain flow rate through the conduit 47 and into the inlet 46. The inlet 46 provides for the discharge of the second solids about the apex 44 and then downwardly along the side surfaces 42 and 43 of the element 39. The homogeneous solids flow passes continuously at the certain rate from the first blending stage 17 downwardly through the outlet 37. For this purpose, the outlet 37 provides a discharge opening 52 which is positioned about the inlet 46 but it is displaced laterally from the apex 44. As a result, these solids flow downwardly along the inclined side surfaces 42 and 43 where they are in uniform peripheral flow conditions in contact with the second solids.

The action of the element 39 in the second blending stage 18 produces a homogeneous solids flow which passes from the element 39 downwardly through the region 45 to the conical bottom 14 and subsequent discharged through the outlet 16 from the vessel 12. In this case, the "second" solis have uniformly distributed therein both the first solids introduced through the inlet 26 and also the other "first" solids introduced through the inlet 46. For practical purposes, the blending stages 17 and 18 can be constructed in substantially similar arrangements or other equivalent arrangements capable of uniformly distributing one solids flow into another solids flow.

It will be apparent that the vessel 12 may be provided with a plurality of blending stages each of which is separated by a collector so that the homogeneous solids flows from the vertically superimposed blending stage becomes the "second" solids flow into the subtended blending stage. Additionally, several "first" solids of the same or different nature may be introduced through other arrangements employing the inverted Vee elements as has been described relative to FIG. 1.

Preferably, the inverted Vee elements 19 and 39 are right conical structures which may be constructed from sheet metals, such as aluminum or steel. Also, it is preferred that the inlets 26 and 46 are tubular so that there is provided a concentric flow of the dispersed solids about the apex of the Vee elements. In this regard, the inlets should also be arranged to provide discharge openings 32 and 52 that are annular and positioned concentrically about the inlets with the annular discharge openings being spaced laterally from the apex of the inverted Vee elements.

Preferably, each blending stage operates in a manner that in a region above the spiders 24 and 41, a layer of the dispersed solids and the bulk solids flow concomitantly along the side surfaces of the elements 19 and 39. The remainder of the region above the spiders, and especially along the side surfaces, should be free of accumulating amounts of the flowing solids. Stated in another manner, the solids introduced through the inlets should flow at uniform peripheral flow conditions along the elements 19 and 39. The resulting homogeneous solids flows are then discharged into the regions 35 and 45 below each of the inverted Vee elements. These regions may contain some accumulated solids in small volumes. Preferably, the solids enter the regions 35 and 45 at the same rate as they are discharged from them so that there is always a continuous uniform flow of solids along the vertical axis of the vessel 12.

Figure 2:
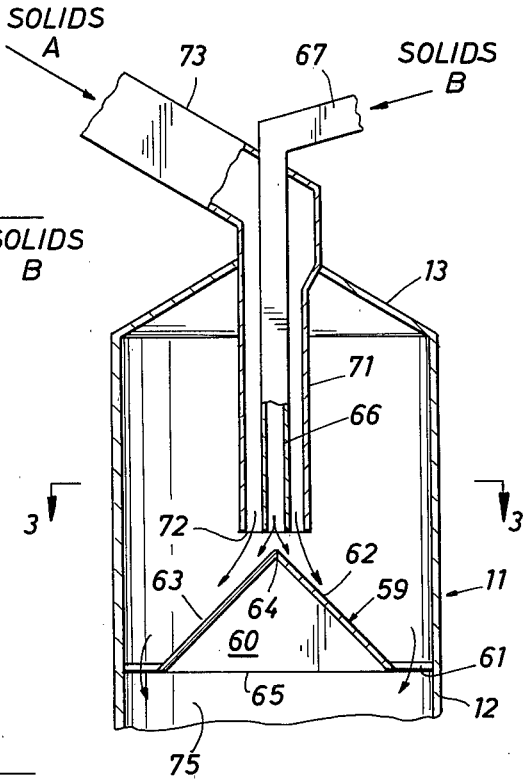
FIG. 2 is a partial elevation of a second embodiment of the blending stage which may be employed in the system shown in FIG. 1.
Figure 3:
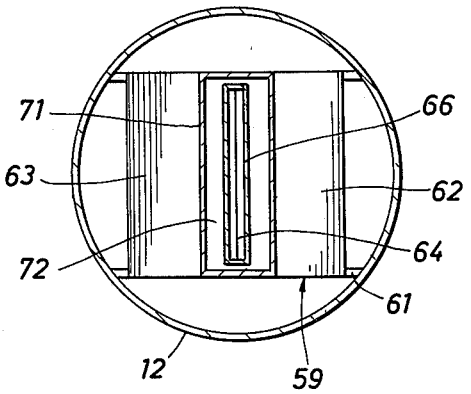
FIG. 3 is a sectional view taken along line 3—3 of the blending stage shown in FIG. 2.

If desired, the inverted Vee elements can be constructed of any shape such as triangular in vertical section as is shown in the alternative blending stage 60 of FIGS. 2 and 3. More particularly, the blending stage 60 is provided by an elongated triangular metal element 59 which can be secured to the vessel 12 by spiders 61. The element 59 has planar side surfaces 62 and 63 of sheet metal which intersect at an apex 64. The side surfaces may have equal lengths and oriented at the same angular dimensions as previously discussed. The element 59 may be closed by ends (not shown) and a metal floor 65, if desired. The side surfaces 62 and 63 extends substantially along the width of the vessel 12.

Since the element 59 is elongated in the horizontal, the flows of the solids onto it can be provided by a rectangular inlet arrangement. For this purpose the blending stage 60 is provided with a horizontally disposed rectangular inlet 66 that is positioned vertically above the apex 64 and extends substantially the horizontal dimension of the element 59. The inlet 61 is connected to a source for supplying at a certain rate a continuous flow of the first solids from a suitable container external of the vessel 12. This flow of dispersed solids passes through a conduit 67 into the inlet 66 from whence they flow about the apex 64 and then downwardly along the side surfaces 62 and 63.

In a like manner, the blending stage 60 includes an inlet 71 which is also rectangular in horizontal configuration and provides a rectangular discharge opening 72 about the inlet 66. This rectangular discharge opening 72 is spaced laterally from the apex 64. The inlet 71 is connected to a conduit 73 which receives a continuous flow at a certain rate of the second solids from a suitable container. These solids flow downwardly into the inlet 71 and then pass through the rectangular discharge opening 72 to flow downwardly along the side surfaces 62 and 63 of the element 59. As a result, there is a uniform distribution of the first solids into the second solids provided by the action of the element 59. It will be apparent that the element 59 functions exactly in the same manner to produce the homogeneous solids flow into the region 75 as was described for the inverted Vee element 19 in the blending stage 17 described relative to FIG. 1. These homogeneous solids gravitate from the region 75 to the outlet 16 for removal to a subsequent utilization.

Figure 4:
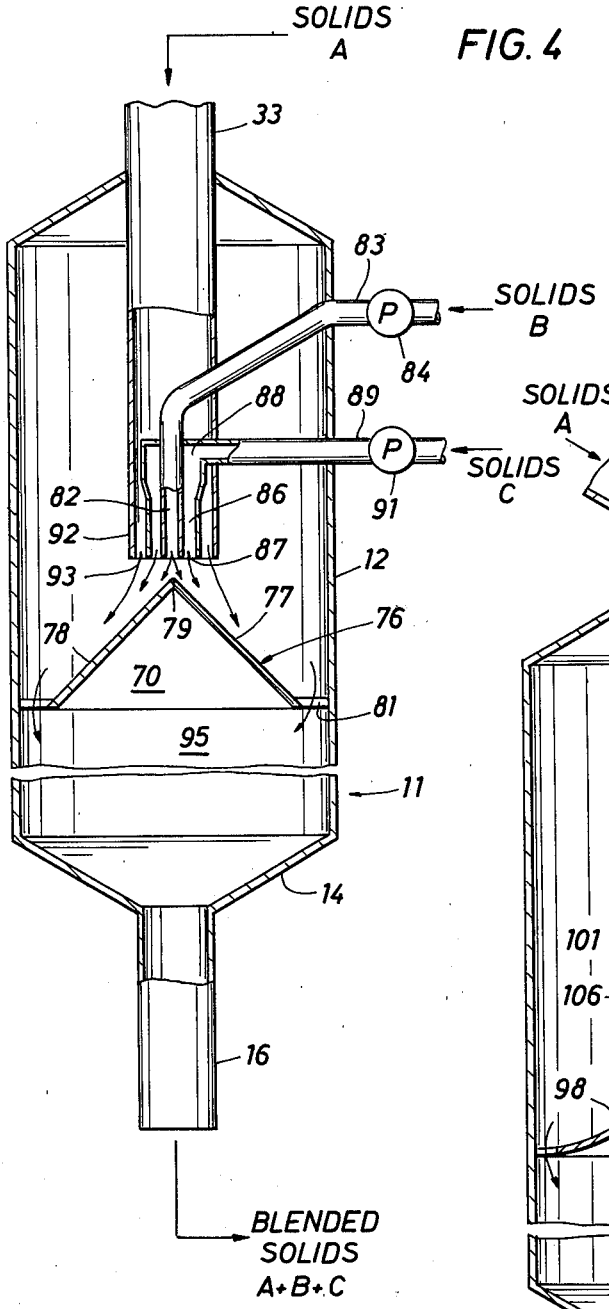
FIG. 4 is an elevation, partially in section, of yet another blending stage for use in the system of the present invention wherein a plurality of dispersed solids can be uniformly distributed within a bulk solids flow in one blending stage.

Referring now to FIG. 4, there is shown yet another embodiment of a blending stage 70 arranged according to the present invention. This stage can be placed within the vessel 12 and like elements bear like designations to simplify the present description. The vessel 12 contains an inverted Vee element 76 which provides inclined side surfaces 77 and 78 merging at an apex 79 that is pointed upwardly. Preferably, the element 76 is a right conical member formed of sheet metal or the like that is held to the vessel 12 by spiders 81. The vessel 12 carries the conical bottom 14 with the outlet 16, as was previously described. An inlet 82 is provided for a first solids (i.e. colorant particles) which is introduced through a tubular conduit 83 by a pump 84 to supply a continuous flow at a certain rate from a suitable external source of these solids. The inlet 82 is vertically aligned with the apex 79. A second tubular inlet 86 is provided the blending stage 70 and may be a cylindrical nozzle which is placed in surrounding relationship to the inlet 82. The inlet 86 provides an annular discharge opening 87 concentric with the inlet 82 and spaced laterally from the apex 79 of the element 76. The inlet 86 connects to a feed chamber 88 that is supplied with a continuous flow at a certain rate of another solids (i.e., mold release granules) through a conduit 89 by a pump 91 from an external source of these solids. As a result, the first solids flow through the inlet 82, downwardly about the apex 79, and then, downwardly in uniform peripheral flow along the inclined side surfaces 77 and 78. The other solids flow from the inlet 86, and then, downwardly along the side surfaces 77 and 78 so as to be uniformly distributed within the first dispersed solids. The "second" solids (i.e., plastic pellets) are supplid by the same arrangement as was described relative to FIG. 1. For this purpose, the conduit 33 provides a continuous flow at a certain rate of these solids into a tubular inlet 92. These bulk solids pass from the inlet 92 and through an annular discharge opening 93 which is positioned concentrically about the inlet 86 but spaced laterally from the apex 79 of the element 76. As a result, these solids flow downwardly along the side surfaces 77 and 78 of the element 76. The flows of all these solids are under substantially identical uniform peripheral flow conditions and produce a uniform distribution of the "first" solids within the second solids upon their travel along the side surfaces 77 and 78 of the element 76. The homogeneous solids flow from the side surfaces 77 and 78 into the area 95 below the element 76. Then, the homogeneous solids flow is removed through the outlet 16 of the vessel 12. Preferably, the embodiment in the blending stage 70 shown in FIG. 4 employs the element 76 as a right conical structure and the inlets 82, 86 and 92 have circular discharge openings so that most optimum uniform peripheral flow conditions along the surfaces 77 and 78 are obtain.

Figure 5:
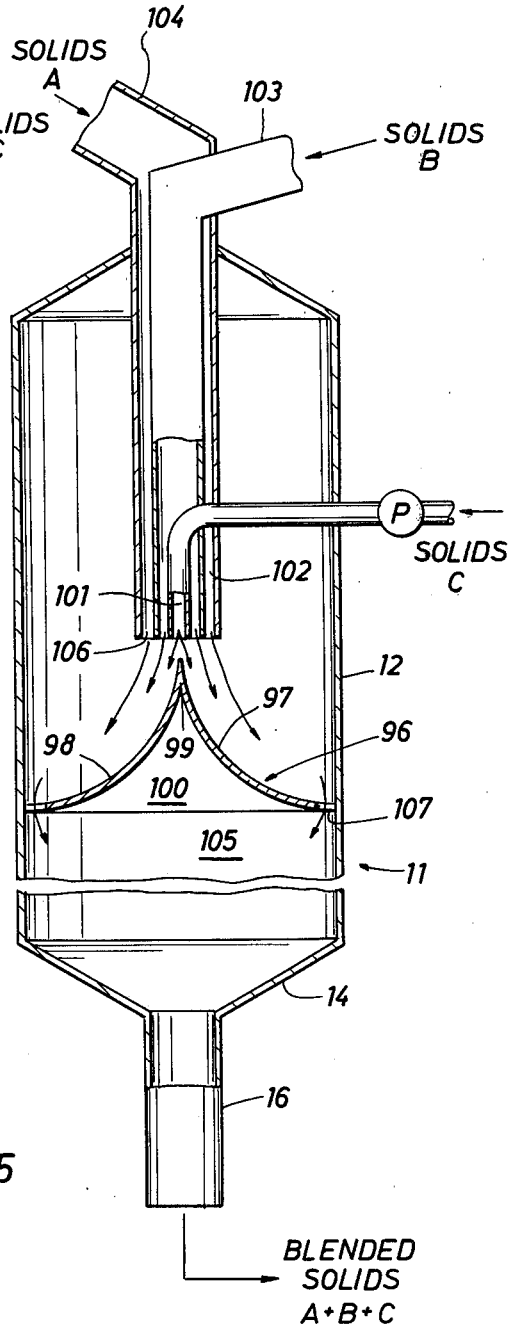
FIG. 5 is a partial elevation of another embodiment of the blending stage shown in FIGS. 2 and 3.

If desired, the inverted Vee elements also can be constructed within side surfaces of curve or flared shape such as is shown in the alternative blending stage 100 of FIG. 5. The blending stage 100 is provided in the vessel 12 by an elongated curved metal element 96 which can be secured to the vessel 12 by spiders 107. The element 96 has flared or curved side surfaces 97 and 98 of sheet metal which intersect at an apex 99. The side surfaces may have equal lengths and oriented at the same angular dimensions as previously discussed. Usually the side surfaces will have a fixed or exponential curvature but other curved surfaces may be used. The element 96 may be closed by ends (not shown) and a metal floor 108, if desired. The side surfaces 96 and 97 extend substantially along the width of the vessel 12.

Since the element 96 is elongated in the horizontal as was element 59 in FIGS. 2 and 3, the flows of the solids onto it can be provided by a rectangular inlet arrangement. For this purpose the blending state 100 is provided with a horizontally disposed rectangular inlet 101 that is positioned vertically above the apex 99 and extends substantially the horizontal dimension of the element 96. The inlet 101 is connected to a source for supplying at a certain rate a continuous flow of the dispersed solids from a suitable container external of the vessel 12. This flow of dispersed solids passes through a conduit 103 into the inlet 101 from whence they flow about the apex 99 and then downwardly along the side surfaces 97 and 98.

In like manner, the blending state 100 includes an inlet 102 which is also rectangular in horizontal configuration and provides a rectangular discharge opening 106 about the inlet 101. This rectangular discharge opening 106 is spaced laterally from the apex 99. The inlet 102 is connected to a conduit 104 which receives a continuous flow at a certain rate of the bulk solids form a suitable container. These bulk solids flow downwardly into the inlet 102 and then pass through the rectangular discharge opening 106 to flow downwardly along the side surfaces 97 and 98 of the element 96. As a result, there is a uniform distribution of the dispersed solids into the bulk solids provided by the action of the element 96. It will be apparent that the element 96 functions exactly in the same manner to produce the homogeneous solids flow into the region 105 as was described for the inverted Vee element 59 in the blending stage 60 described relative to FIGS. 2 and 3. These homogeneous solids gravitate from the region 105 to the outlet 16 for removal to a subsequent utilization.

It is apparent that several blending stages can be combined in like array, or in any arrangement of unlike kind of blending stages, into a common vessel to produced any desired type of blending of a flow of first solids into a second solids flow. More particular, the present blending system is capable of dispersing uniformly a flow of a solid particulate material, such as colorant, mold release agent, or other plastic additive, in amounts of approximately 1/10th of a percent by weight into a continuous flow of solids plastic pellets which can have a total volumemetric flow rate of 80,000 pounds per hour. This result can be obtained in a single pass through the vessel 12 wherein the blending stages are arranged in accordance with the present invention. With this particular blending system, the plastic pellets can be moved as a continuous flow from one large container, such as a railroad car, through the blending system of the present invention wherein there is dispersed uniformly the various colorants, mold release agents, slip master batch, and other additives, and the resultant homogeneous solids flow without interruption into another container, such as a railroad car for shipment directly to the ultimate user.

An important advantage resides in the ability of the present blending system 11 to be interrupted without destroying the operation of the system. For this purpose, the pumps 28 34 and 47 associated with FIG. 1 can be all stopped by a common signal. Since the incoming solids flows all terminate substantially simultaneously, all the solids within the vessel 12 will continue to flow downwardly into the outlet 16 and removal therefrom as the homogeneous solids flow. When it is desired to restart the blend system 11, the pumps 28, 34, and 48 are started simultaneously. Now, all of the incoming solids again flow continuously at the certain rates which were predetermined for the desired composition of the homogeneous solids. The unique continuous flow characteristics of the present blending system immediately re-establishes on the inverted Vee elements the desired fixed proportions between the first solids and the second solids flowing through the system.

From the foregoing description, it will be apparent that there has been provided a novel blending system which is especially adapted for dispersing continuously a fixed proportion of a first solids flow into a second solids flow whereby in a single pass there is formed a homogeneous solis flow in which there is a uniform distribution of the first solids within the second solids. It will be understood that certain changes or alterations in the present blending system may be made without departing from the spirit of this invention. These changes in the blending system are contemplated by and are believed within the scope of the appended claims which define the present invention. Additionally, the present description is intended to be taken as an illustration of this blending system.

What is claimed is:

1. A blending system for dispersing continuously in a fixed proportion of a first solids flow into a second solids flow thereby forming a homogeneous solids flow comprising:

(a) an upright vessel at its low extremity having an outlet for the homogeneous solids flow;

(b) at least one blending stage disposed within said vessel above said outlet;

(c) at least one blending stage provided by an inverted Vee element with inclined side surfaces mounted centrally in said vessel and with its apex pointed upwardly, a first inlet for the first solids mounted in said vessel vertically above the apex of said element, a second inlet for the second solids mounted in said vessel with a discharge opening abut said first inlet and displaced laterally from the apex of said element;

(d) first means for supplying at a certain flow rate the first solids through said first inlet to flow about the apex of said element and downwardly along its side surfaces;

(e) second means for supplying at a certain flow rate the second solids through the second inlet to flow downwardly along the side surfaces of said element whereby the first solids are uniformly distributed into the second solids to produce a homogeneous solids flow through said outlet from said vessel; and, (f) said vessel contains a second blending stage which includes a second inverted Vee element with inclined side surfaces and with its apex pointed upwardly, a third inlet mounted in said vessel vertically above the apex of said second element, a fourth inlet mounted in said vessel with a discharge opening about said third inlet and spaced laterally from the apex of said second element, third means for supplying at a certain flow rate solids through said third inlet to flow about the apex of said second element and downwardly on its side surfaces, and fourth means to supply at a cetain flow rate the homogeneous solids from the first blending stage as the solids flow through the fourth inlet to flow downwardly along the side surfaces of said second element, whereby there is a uniform distribution of the solids from said third inlet into the solids from the fourth inlet to produce a second homogeneous solids to flow through said outlet from said vessel.

2. The blending system of claim 1, wherein both said inverted Vee elements are right conical elements in superimposed relationship with a right conical collector interposed between said elements, and said third inlet being connected to said collector for passing the homogeneous solids from said element of said first blending stage as the solids supplied to said fourth inlet of said second element in said second mixing stage.

3. A blending system for dispersing continuously in a fixed proportion of a first solids flow into a second solids flow thereby forming a homogeneous solids flow comprising:

(a) an upright cylindrical vessel at its lowest extremity having an outlet for the homogeneous solids flow;

(b) at least one blending stage disposed in said vessel above said outlet;

(c) at least one blending stage provided by an inverted right conical element with inclined sides mounted centrally in said vessel and with its apex pointed upwardly, a first inlet for solids mounted in said vessel and positioned coaxially above the apex of said element, and a second inlet for solids mounted in said vessel with an annular discharge opening positioned concentrically about said first inlet and spaced laterally from said apex of said element;

(d) first means for supplying at a certain rate solids through said first inlet to flow about the apex of said element and downwardly on its surfaces;

(e) second means for supplying at a certain rate solids through the second inlet to flow downwardly along the side surface of said element whereby the solids from said first inlet are uniformly distributed into the solids from said second inlet to produce a homogeneous solids flow through said outlet from said vessel; and, (f) said vessel contains a second blending stage which includes a second inverted right conical element with inclined side surfaces mounted centrally in said vessel, a third inlet mounted in said vessel and positioned coaxially above the apex of said second element, a fourth inlet mounted in said vessel with an annular discharge opening positioned concentrically about said third inlet and spaced laterally from the apex of said second element, third means for supplying solids through said third inlet to flow about the apex of said second element and downwardly on its side surfaces; and fourth means for supplying the homogeneous solids from the first blending stage as the solids through the fourth inlet to flow downwardly along the side surfaces of said second element, whereby there is a uniform flow distribution of the solids from said third inlet into the solids from said fourth inlet to produce a second homogeneous solids to flow through said outlet from said vessel.

* * * * *